United States Patent [19]

Block et al.

[11] 4,290,097

[45] Sep. 15, 1981

[54] HIGH-PRESSURE DISCHARGE LAMP AND REFLECTOR COMBINATION

[75] Inventors: Werner Block, Taufkirchen; Manfred Pilsak; Klaus Düsedau, both of Munich; Wolfgang Greiler, Unterhaching, all of Fed. Rep. of Germany

[73] Assignee: Robert Bosch GmbH, Stuttgart, Fed. Rep. of Germany

[21] Appl. No.: 66,664

[22] Filed: Aug. 15, 1979

[30] Foreign Application Priority Data

Sep. 14, 1978 [DE] Fed. Rep. of Germany ..... 2840031

[51] Int. Cl.[3] ..... F21V 7/20

[52] U.S. Cl. ..... 362/264; 362/345

[58] Field of Search ..... 362/265, 264, 345, 373

[56] References Cited

U.S. PATENT DOCUMENTS

| | | | |
|---|---|---|---|
| 3,700,881 | 10/1972 | Slomski | 362/265 |
| 3,703,635 | 11/1972 | Burkarth | 362/264 |
| 3,720,822 | 3/1973 | Rochester | 362/264 |

*Primary Examiner*—Donald P. Walsh

*Attorney, Agent, or Firm*—Frishauf, Holtz, Goodman & Woodward

[57] ABSTRACT

A-C high-pressure discharge lamp and reflector combination assembly in which the reflector and the lamp are each separately and individually cemented into a base, but are not cemented together. Ventilation openings are formed between the lamp and the reflector in the base, to permit air to pass between the base and the lamp, and between the lamp and the reflector. Preferably, the reflector at the end remote from the base is surrounded with a ceramic end ring, at the inner circumference of which extends a metallic ribbon or strip which has radially extending connecting portions to the electrical terminals of the lamp, placed edgewise with respect to the light radiation to provide for essentially shadowless electrical connection and high-voltage insulation between the lamp terminals. Constructing the lamp as an a-c lamp permits lifetimes in the order of hundreds of hours for a lamp of comparable power and size with respect to d-c high-pressure lamps.

15 Claims, 3 Drawing Figures

HIGH-PRESSURE DISCHARGE LAMP AND REFLECTOR COMBINATION

The present invention relates to a high-pressure discharge lamp and reflector combination forming a unitary assembly, and more particularly to such a lamp suitable for use in amateur and commercial motion picture projection, for slide projectors, and the like.

BACKGROUND AND PRIOR ART

A lamp of the type to which the present invention relates, and over which the present invention is an improvement, is described in U.S. Pat. No. 3,700,881 Slomski. In the arrangement of this U.S. patent, the lamp bulb is cemented into the end of the neck of the reflector which surrounds the entire end of the lamp. A free or hollow space arises in this construction in advance of the cementing position between the end of the lamp bulb and the neck of the reflector. This hollows space forms a heat retaining zone, the purpose of which is to provide for a low temperature gradient with respect to the length of the space and thus prevent thermal stresses. The heat storage capability is improved by forming the neck of the reflector in conical shape, so that the space becomes smaller or tapers towards the outer end of the lamp. A single cap is used to close off the arrangement, secured by a cement, and surrounding the neck of the reflector. The lamp current leads are conducted outwardly through an opening in the side wall of the cap. Such a lamp is useful as a direct current arc discharge lamp in which the anode is surrounded by the neck of the reflector and of the heat retention space. The current supply of the end of the lamp in the direction in which light is emitted is returned towards the end cap within the reflector. In spite of this rather complex construction, the lifetime of the arrangement is between 25 to 50 hours, which is short for commercial utilization of this type of lamp of projection purposes.

THE INVENTION

It is an object to provide a unitary assembly of lamp bulb and reflector which has a substantially higher lifetime with good light efficiency and with good color temperature and rendition and which, preferably, can be constructed in even smaller dimensions.

Briefly, the lamp bulb as well as the reflector are mechanically solidly connected with the base, but not with each other, and the arrangement is so made that a ventilation opening will arise between the lamp bulb and the reflector.

Drawings, illustrating a preferred example, wherein.

Figure 1:
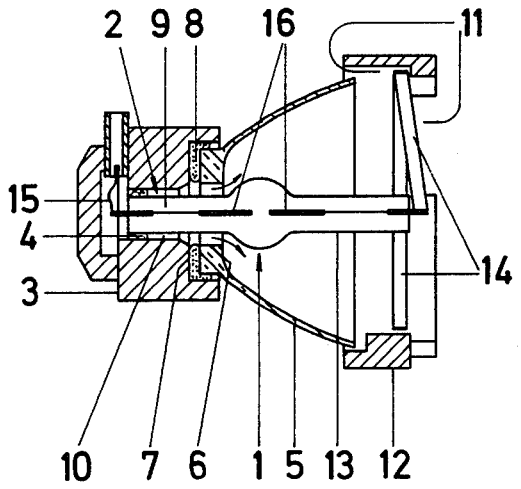
FIG. 1 is a schematic cross-section of the lamp-reflector combination.

The lamp bulb 1 (FIGS. 1, 3) is located in the opening 2 of the base 3 and secured therein by a cement 4. The reflector 5 is formed with a short extension or neck 6 which has an inturned flat surface which fits against a matching shoulder in the base 3. The reflector 5 is secured to the base 3 by cement 8 surrounding the neck 6. The socket or base is essentially circular, but is not solidly cylindrical; rather, the base is formed with lateral openings 3*a* (FIG. 2) through which air can pass. In FIG. 1, the air will pass in a direction perpendicular to the plane of the drawing. A portion of the cooling air passes between the neck of the reflector and the end 9 of the lamp 1 bulb which is close to the base, and into the space 10 defined between this end 9 of the lamp and the base, passes the lamp bulb, and then passes into the reflector, as seen by the small arrows in FIG. 1.

A closing ring 12 formed with openings 11 (FIG. 3) therein closes off the end of the reflector 5 at the light exit opening. The closing ring 12 preferably is of ceramic. The end or shaft 13 of the lamp bulb at the side of the light exit opening is connected to a current supply strip 14, preferably a nickel-plated copper strip which extends partially, in ring form, at the inside of the closing ring 12. A current connection lead 15 is secured to the lamp electrode in the base.

Figure 3:
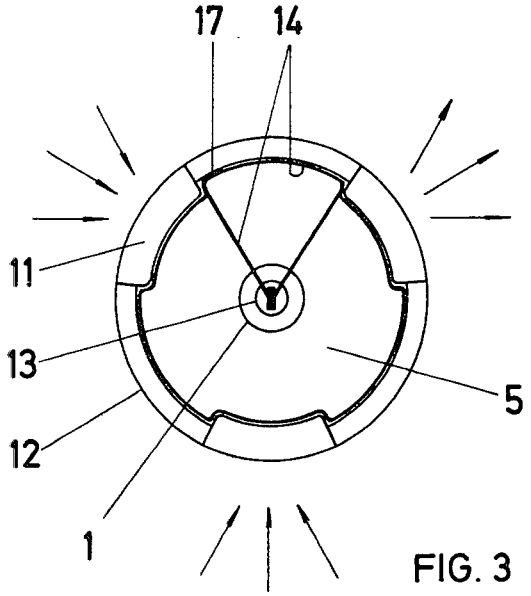
FIG. 3 is an end view of the lamp from the reflector end.
Figure 2:
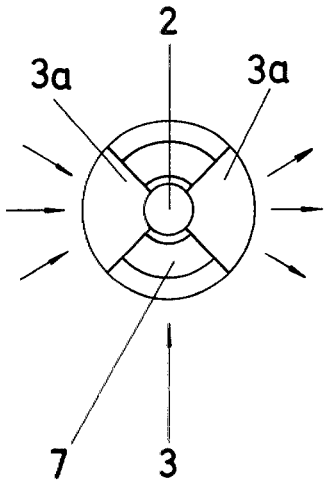
FIG. 2 is an end view of the base.

FIG. 2 clearly shows the openings 3*a* in the base which, preferably, is of a ceramic. FIG. 3 shows the arrangement of the current supply 14 within the closing ring 12, and a connection 17 which permits a further connection of the strip 14 with an external current supply, for example by a welded pigtail, a compression contact, or the like. The path of cooling air is indicated schematically by arrows in FIGS. 1, 2 and 3.

The lamp bulb 1 is an a-c halogen metal vapor lamp having a single bulb. The arc energy, wall loading, and the fill are optimized. The fill contains, essentially, mercury and rare-earth halogen compounds. The distance between the electrodes 16 is about 3 mm. Such a lamp has a nominal power rating of 270 W. The outer diameter of the closing ring 12 is about 55 mm, and the overall length of the lamp is about 65 mm.

Various changes and modifications may be made. The base or socket may have differently shaped, or different numbers of openings therein. Preferably, the socket is made of an insulating, temperature-resistant ceramic element in which the openings are uniformly distributed over its circumference, and further formed with a central opening which, towards the reflector, has a step-like enlargement to form the abutment or shoulder in which the reflector can be secured, preferably cemented. The lamp bulb is introduced from the side of the reflector into the neck of the reflector after the reflector has been secured to the base and, after optical positioning of the lamp bulb with respect to the reflector, is secured within the base. The regions of attachment of the lamp bulb and the base on the one hand and of the reflector and the base on the other are different. The neck of the reflector, which in general is cylindrical, and which has an inner diameter which is larger by several millimiters than the outer diameter of the end 9 of the lamp bulb, thus leaves the gap 10. It surrounds the end 9 of the lamp only over a portion of its length. The attachment, preferably, can be done by a standard lamp adhesive cement, but can, also, include mechanical attachment, such as a compression spring. The lateral openings in the base, as well as the ring-shaped space 10 between the end 9 of the lamp and the neck of the reflector provides for efficient cooling of the end of the lamp bulb as well as of the lamp within the reflector. Thus, alternating current discharge lamps can be used in the arrangement and the substantially longer lifetime thereof can be utilized. The longer lifetime or a-c lamps, with respect to d-c discharge lamps, are a consequence of the symmetrical construction of the discharge bulb, and the geometry of the electrodes. Particularly with metal halogen compound additives in the fill, the first two halves of the bulb can have approximately equal optimal temperature distribution and particle density distribution. In d-c lamps this is different, since their anode connection may have only a small temperature gradient. In the lamp in accordance with the present invention, extensive cooling of the end 9 of the lamp bulb provides, in contrast, for a high-temperature gradient. This ensures that the end of the lamp bulb will have the requisite necessary temperature in order to permit long lifetime of the curent supply components which, in course of operation of the lamp, react with the oxygen in the air, without interfering, otherwise, with the high bulb temperature which is required for high light output and color quality. A typical bulb temperature is in the order of about 1000° C. Alternating current operation has the additional advantage that the arc position does not shift due to burn-off of the cathode, as is the case in d-c lamps.

The outer reflector ring 12 is not strictly necessary although, in a preferred form, the ring 12 is used and made of a temperature-stable, that is, high temperature-resistant material, preferably an insulating material such as ceramic, and formed in the shape of a ring with recesses, notches, or grooves therein. These recesses or grooves, preferably, are located at the edges of the ring, uniformly distributed about its circumference; alternatively, they can be formed by differential wall thicknesses which, then, will form openings between the reflector and the ring. Thus, cooling air can flow not only within the base, surrounding the lamp end 9 at the base and passing through the reflector, but cooling air can additionally flow around the lamp at the end thereof remote from the base. The closing ring 12 also permits an insulating terminal end and facilitates predetermined positioning of the lamp within an optical apparatus, for example within a projector, where the lamp is to be positioned with respect to a film gate or other aperture. The ring 12 may be formed with suitable cams or projections, for example in form of a bayonet seat, with matching seat in the projector itself. The ring, further, can be used to prevent laterally stray light from emanating from the lamp and provide for mechanical protection by extending over the end of the lamp bulb.

The metallic strip 14 which provides the electrical connection to the lamp 1 at the end remote from the base is preferably so constructed that it is a metal strip made of a material which is highly heat-conductive, radiation-reflective and, because of its low extent in the direction of radiation, does not cast any annoying shadows. Preferably, and as shown, the strip 14 extends within the entire circumference of the reflector edge; and at least over a portion of the circumference thereof. The further current supply connection then can be connected outside of the reflector, which has the additional advantage that any interference with the light output from the lamp in the region of the reflector is effectively avoided. Better insulation is also achieved so that the lamp can be started or fired when hot. If hot-starting is desired, then the supply connections to the lamp are preferably insulated from each other with high-voltage insulation.

The reflector preferably is constructed as an interference edge filter in which radiation of the visible spectrum is reflected, whereas radiation within the ultraviolet and infrared ranges is effectively suppressed.

It has been found that lifetimes of several hundred hours, and even over 500 hours, have been achieved with little wobble of the arc and excellent adjustment capability within the projector. The high light output and good color rendition make this lamp particularly suitable for still picture and motion picture projection, for example for projection of Super-8 mm film, 16 mm film, 35 mm film, for slide projection of slides of any format and the like. The lamp is particularly compact and more so than d-c arc lamps of generally similar construction which it can replace.

We claim:

1. High-pressure discharge lamp and reflector combination assembly comprising an essentially bowl-shaped reflector (5) having a central opening at the reflector base end and open at the reflector light exit end;

a high-pressure discharge lamp bulb (1, 9, 13) having a projecting bulb base end (9) positioned longitudinally with respect to the reflector axis;

and a base (3) including an insulating, essentially cylindrical socket of temperature-resistant material formed with an inner recess slightly bigger than the bulb base end (9) to receive the bulb base end therein with clearance and to form an air circulation space between the base bulb end and said recess;

air circulation openings **(3*a*) formed in the base and communicating with said air circulation space surrounding the bulb base end (9)**, distributed along the circumference of the base;

the bulb base end (9) being irremovably secured within said recess;

and the reflector (5) being individually and separately irremovably secured to the base, surrounding the projecting bulb base end and spaced therefrom, the central opening thereof being in air flow communication with said air circulating space to provide a continuous ventilating path from said air circulating opening **(3*a*)** in the base, through said air circulating space past the base end of the bulb and into the reflector, and out of the open lightemitting end of the reflector for heat exchange of ambient air between the inside of the base, the lamp bulb, and the reflector.

2. Lamp-reflector combination according to claim 1, wherein the lamp (1) and the reflector (5) are connected to the base at respectively different longitudinal—with respect to the lamp bulb—locations thereon.

3. Lamp-reflector combination according to claim 1, wherein the projecting bulb end of the lamp (1) comprises an extending lamp shaft (9) and the reflector (5) base end has a projecting end portion (6) which surrounds the end shaft (9) of the lamp only to a fraction of its entire length.

4. Lamp-reflector combination according to claim 1, wherein the projecting bulb end of the lamp comprises an extending lamp shaft (9) and the reflector base end has a projecting end attachment portion (6), the projecting end attachment portion of the reflector being essentially circular in cross section and surrounding the shaft (9) of the lamp with clearance.

5. Lamp-reflector combination according to claim 1, further including an end ring (12) secured to the reflector at the light exit end thereof and made of a temperature stable material.

6. Lamp-reflector combination according to claim 5, wherein the end ring is formed with air ventilation openings (11).

7. Lamp-reflector combination according to claim 5, wherein the end ring comprises insulating material.

8. Lamp-reflector combination according to claim 7, wherein the end ring is ceramic.

9. Lamp-reflector combination according to claim 1, wherein the lamp is elongated and has current supply terminals at both ends;

an end ring of insulating material (12) is provided, positioned at the light exit end of the reflector;

and wherein a metallic strip extending at least in part around the circumference of the end ring and having radially projecting portions is provided and forms a current supply connection to the terminal of the elongated lamp at the side remote from the base.

10. Lamp-reflector combination according to claim 9, further comprising a current connection supply point (17) connecting electrical current outwardly of the reflector to the metallic strip (14).

11. Lamp-reflector combination according to claim 10, wherein the current supply connections are insulated with each other with respect to high voltage.

12. Lamp-reflector combination according to claim 1, wherein the lamp is an a-c discharge lamp.

13. Lamp-reflector combination according to claim 12, wherein the lamp is a halogen metal vapor discharge lamp having a single bulb.

14. Lamp-reflector combination according to claim 1, wherein the reflector at the inside is an interference edge reflector which reflects essentially radiation derived from the lamp within the visible spectral range while suppressing spectral components in the ultraviolet and infrared ranges.

15. Lamp-reflector combination according to claim 1, wherein the base comprises an insulating temperature-resistant ceramic element formed with said ventilation openings;

the lamp bulb (1) and the reflector (5) are concentrically positioned elements, and further including an end ring (12) of ceramic material, and a current supply connection to the lamp (14) extending from the end ring and at least in part located at the interior circumference thereof, and formed as an edge-positioned strip of highly heat-conductive, radiation-reflective metal formed with a terminal connection (17) at the outside of the reflector;

and wherein the lamp is an a-c halogen-metal vapor discharge lamp with a single bulb.

* * * * *

UNITED STATES PATENT AND TRADEMARK OFFICE

CERTIFICATE OF CORRECTION

PATENT NO. : 4290097

DATED : September 15, 1981

INVENTOR(S) : Werner BLOCK et al

It is certified that error appears in the above—identified patent and that said Letters Patent is hereby corrected as shown below:

In line [73] Assignee; should be:

Patent-Treuhand-Gesellschaft für elektrische Glühlampen m.b.H.

Fed. Rep. of Germany.

Signed and Sealed this

*Ninth* Day of *February 1982*

[SEAL]

*Attest:*

GERALD J. MOSSINGHOFF

*Attesting Officer*

*Commissioner of Patents and Trademarks*